United States Patent [19]

Holmberg, deceased et al.

[11] Patent Number: 4,644,618

[45] Date of Patent: Feb. 24, 1987

[54] LOCK FOR SAFETY BELLS

[76] Inventors: Göte E. Y. Holmberg, deceased, late of Anderstorp; by Brita G. E. Holmberg, legal representative, Tokarp, Box 2010; by Dick L. L. Holmberg, legal representative, Bergkullavägen 12, both of S-334 00 Anderstrop, all of Fed. Rep. of Germany

[21] Appl. No.: 834,335

[22] PCT Filed: May 22, 1985

[86] PCT No.: PCT/SE85/00212

§ 371 Date: Mar. 21, 1986

§ 102(e) Date: Mar. 21, 1986

[87] PCT Pub. No.: WO85/05258

PCT Pub. Date: Dec. 5, 1985

[30] Foreign Application Priority Data

May 22, 1984 [SE] Sweden ..... 8402750
Aug. 16, 1984 [SE] Sweden ..... 8404109

[51] Int. Cl.[4] ..... A44B 11/26

[52] U.S. Cl. ..... 24/630; 24/632; 24/637; 24/650

[58] Field of Search ..... 24/630, 631, 632, 629, 24/644, 643, 637, 650

[56] References Cited

U.S. PATENT DOCUMENTS 3,451,720 6/1969 Makinen ..... 24/650
3,587,141 6/1971 Brown ..... 24/632
3,605,207 9/1971 Glauser et al. ..... 24/632
3,673,645 7/1972 Burleigh ..... 24/630
4,062,091 12/1977 Holmberg ..... 24/637

*Primary Examiner*—Victor N. Sakran
*Attorney, Agent, or Firm*—Merchant, Gould, Smith, Edell, Welter & Schmidt

[57] ABSTRACT

Lock for safety belts having at least two hip strap parts and two shoulder strap parts, said lock comprising a lock housing to be attached to one hip strap part and enclosing a manually releasable lock mechanism (18), a lock tongue (11) to be attached to the other hip strap part, which can be inserted into an insert opening in the lock housing for co-operation with the lock mechanism, and a fitting (12; 13) for each shoulder strap part to be connected with the lock housing and the lock tongue by these elements being mutually lockingly engaged. In the lock housing there is provided a blocking shoulder (41, 42) which is spring-biased to project partly into the insert opening so as to prevent insertion of the lock tongue to engage the lock mechanism. Moreover, the lock housing forms an insert opening for each fitting to be inserted transversely through the insert opening for the lock tongue, the fitting being engaged with the blocking shoulder and the blocking shoulder being displaced from the insert opening for the lock tongue against the spring bias. The fittings each from an opening (53) the lock housing when the lock tongue is engaged with the lock mechanism.

10 Claims, 9 Drawing Figures

LOCK FOR SAFETY BELLS

Figure 1:
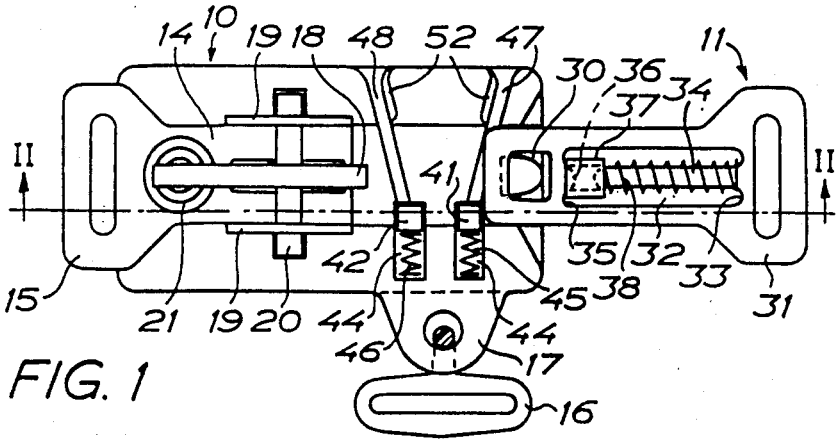

The invention relates to a lock for safety belts having at least two hip strap parts and at least one further strap part.

When safety belts of this kind are used as safety belts for children, the safety belt includes in addition to said two hip strap parts which are attached one at each side of the seat, also two shoulder strap parts which are attached behind the seat, and possibly also a crotch strap part which is attached below in front of the seat and is extended upwards between the legs of the safety belt user. The invention relates particularly to vehicle safety belts of this type with or without the crotch strap part.

A safety belt having five strap parts is disclosed and described in the French patent specification No. 2,116,541. All strap parts in that case are provided with lock tongues which can be inserted into a lock housing including a lock mechanism for co-operation with the lock tongues. On the outside of the lock housing there is a release member which can be actuated manually by several steps for disengagement of the lock tongues of the shoulder straps and for disengagement of the lock tongue of one hip strap part and the lock tongue of the crotch strap part extended upwards between the legs.

It has been noted that one lock tongue or the other of such a lock can be inserted in the lock housing without lockingly engaging the lock mechanism. If this is the case, the safety belt does not, of course, provide the intended protection for the user and in fact the risk of serious injuries to the user may exist should an accident occur, when not all lock tongues are lockingly engaged. In order to eliminate this risk the authorities concerned in some countries have prescribed that there should be obtained an indication of all lock tongues being engaged with the lock mechanism when the safety belt is put into use.

The German utility model registration G No. 8230071.2 discloses and describes a belt lock which satisfies this requirement. The lock is constructed in such a way that the lock housing is attached to one hip strap part and that a lock tongue for co-operation with the lock housing is attached to the other hip strap part. Then, the two shoulder strap parts are provided with fittings which are passed onto projections on the lock housing and/or the lock tongue and are retained on these projections by the lock housing and the lock tongue being lockingly engaged with each other. Thus, it is possible to see directly from the outside if the two shoulder strap parts are attached when the lock tongue and the lock housing are engaged with each other. However, this prior art lock provides the disadvantage that it may be rather difficult to lock the shoulder strap parts, because they must be passed manually onto the projection or projections and must be retained while the lock housing and the lock tongue are being lockingly engaged with each other.

The lock of the invention comprises in a known manner a lock housing to be attached to one hip strap part and enclosing a lock mechanism having a release member to be actuated manually, a lock tongue to be attached to the other hip strap part, which can be inserted into an insert opening in the lock housing for co-operation with the lock mechanism, and a fitting for the further strap part to be connected with the lock housing and the lock tongue by these elements being lockingly engaged with each other.

The purpose of the invention is to provide a lock of a very simple and reliable construction which satisfies the safety requirements now in force and at the same time can be easily handled in use.

Figure 2:
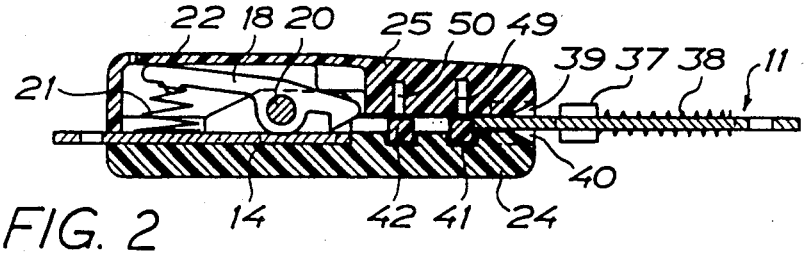
Figure 3:
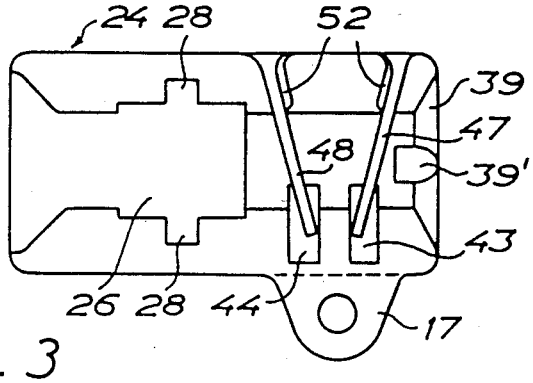
Figure 4:
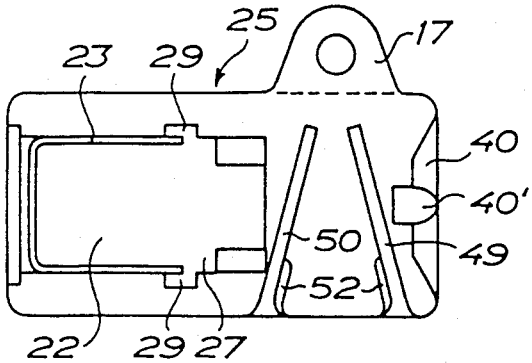
Figure 5:
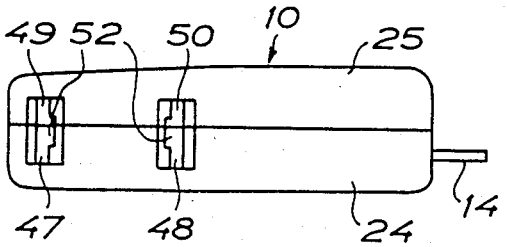
Figure 9:
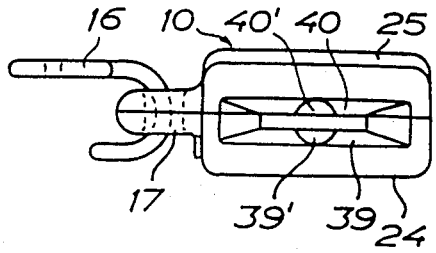
Figure 6:
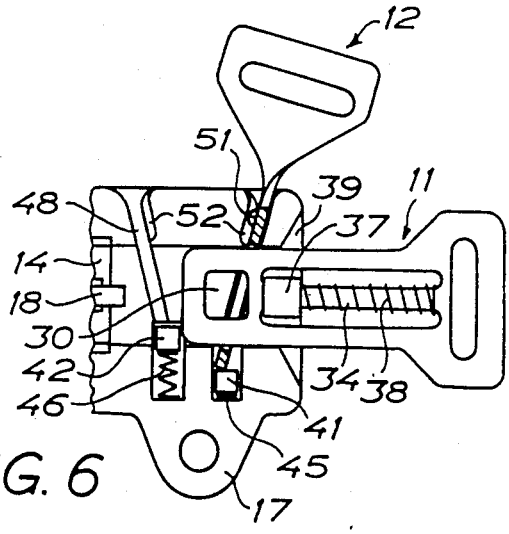
Figure 7:
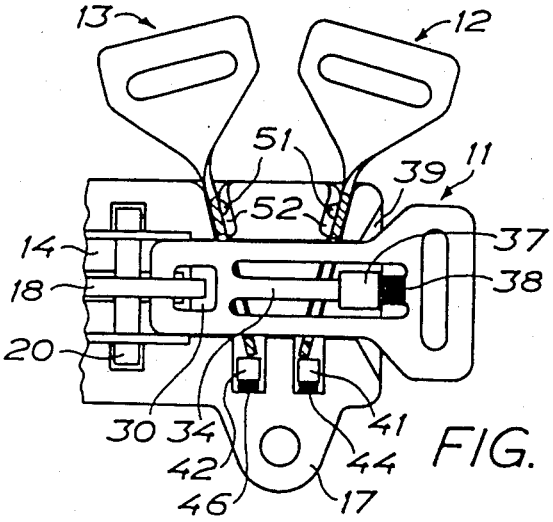
Figure 8:
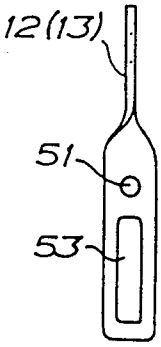

The purpose of the invention is achieved by the lock having obtained the characteristics appearing from claim 1, and in order to explain the invention in more detail an embodiment of this lock will be described below with reference to the accompanying drawings in which FIG. 1 is a plan view of a bottom portion forming part of the lock housing with details mounted thereon and of the lock tongue arranged for co-operation with the lock housing, FIG. 2 is a cross-sectional view along line II—II in FIG. 1, FIG. 3 is a plan view of the bottom portion of the lock housing as seen from the inside thereof, FIG. 4 is a plan view of the top portion of the lock housing as seen from the inside thereof, FIG. 5 is a side view of the lock from the side where the fittings of the shoulder strap parts are to be inserted, FIG. 6 is a fragmentary view similar to FIG. 1, which illustrates the latch function of the lock, FIG. 7 is a fragmentary plan view similar to FIG. 1, which illustrates the lock when used, FIG. 8 is a side view of a fitting forming part of the lock, and FIG. 9 is an end view of the lock as seen from the right side in FIG. 4 but without the lock tongue.

The lock of the invention shown in the drawings, is intended for a safety belt having a hip strap and a crotch strap of the type used as vehicle safety belt for children. The belt includes a lock housing 10 and a lock tongue 11 as well as two shoulder strap fittings 12 and 13. The lock housing includes a lock mechanism having a metal frame 14 which forms an attachment 15 for one hip strap part while the lock tongue 11 should be connected with the other hip strap part and the two fittings 12 and 12 should be connected each with one of the two shoulder strap parts of the vehicle safety belt. A hook 16 is provided for the crotch part and can be hooked into an eye 17 on the lock housing 10.

The lock mechanism can be of any known embodiment but in this case comprises a latch 18 which is pivotally mounted to the frame 14 by means of a cross shaft 20 mounted in side flanges 19 on the frame. The latch is biased by means of a conical compression spring 21 which is engaged between the latch and the frame, and it can be actuated against the bias of said spring from the latching position shown in FIG. 2 to a releasing position against the spring bias by means of a push button 22. This push button is formed by the lock housing as a rectangular flap which is detached from the rest of the lock housing by a slot 23 extending along three sides of the flap. The lock mechanism is received by the lock housing 10 which comprises a bottom portion 24, FIG. 3, and a top portion 25, FIG. 4, the top portion forming the push button 22. The two portions each form one half of the eye 17. A recess 26 is provided in the bottom portion 24, and the frame 14 is located in said recess.

The top portion 25 of the lock housing 10 forms a recess 27 to make space for the lock mechanism. Moreover, there are provided in the bottom portion 24 and in the top portion 25 two opposite recesses 28 and 29, respectively, for receiving the shaft 20 which projects at each side of the frame 14. By this arrangement, the lock mechanism is kept in position in the lock housing when the two portions thereof are interconnected. The interconnection can be provided by means of rivets, screws, or other suitable fasteners, or by ultrasound welding. It is not shown in detail herein how the portions of the lock housing are interconnected, because such interconnection can be made in a quite conventional manner.

The lock tongue 11 forms an aperture 30 for locking engagement by the latch 18 when the lock tongue 11 is inserted in the lock housing. The lock tongue can be released by the push button 22 being depressed such that the latch 18 will be pivoted to disengage the lock tongue. The lock tongue forms an attachment 31 for the other hip strap part and has a longitudinal substantially rectangular slot 32 from one end edge 33 of which a tail 34 projects, which is considerably narrower than the slot 32 and extends towards the other end edge 35 thereof. The tail terminates at a distance from the end edge 35 which forms a projection 36 directed towards the end of the tail 34 in register with said end. A cylindric sleeve 37 which can be made of plastic material, is received in the slot 32 and is displaceably guided by means of the tail 34. Between the sleeve 37 and the end edge 33 of the slot 32 a helical compression spring 38 is engaged which surrounds the tail 34. Thus, the sleeve 37 will be displaced from the end edge 35 towards the end edge 33 along the tail 34 against the bias of the spring 38.

When the lock tongue is inserted into the lock housing 10, the sleeve 37 will immediately be engaged with the lock housing at the outside thereof and by continued insertion of the lock tongue into the lock housing the sleeve 37 will be displaced along the tail 34, the compression spring 38 then being compressed. When the lock tongue at the aperture 30 thereof engages the latch 18 in the lock housing 10, the spring 38 thus will be compressed and will exert a force on the sleeve 37. By the dimensioning of the spring, said force should be adjusted such that the lock tongue can be inserted in a comfortable manner into the lock housing, but there is also exerted onto the lock tongue, when it is more or less inserted in the lock housing, a force which is sufficient for ejecting the lock tongue from the lock housing overcoming the frictional forces encountered therein, when the lock tongue is disengaged from the lock mechanism.

The sleeve 37 can be replaced by an element which is guided on the lock tongue e.g. at the longitudinal edges of the slot 32. The ejector mechanism provided in the lock tongue also can be replaced by a conventional ejector mechanism inside the lock housing, but the ejector mechanism disclosed and described herein is preferred, because it can include a heavy spring which cannot be arranged in the lock in the same easy manner without making the lock larger and heavier, which is not suitable in case of locks which are to be used by children.

The lock mechanism can be of any other suitable embodiment. However, the lock mechanism shown herein may be preferred, because it includes a small number of elements.

For the insertion of the lock tongue 11 into the lock housing there is provided in the bottom portion 24 a recess 39 and in the top portion 25 a recess 40, these two recesses forming a passage for guiding the lock tongue towards the lock mechanism, when the lock housing is assembled. In order to facilitate the insertion of the lock tongue this passage is flared at the opening thereof. Two complementary semi-cylindrical recesses 39' and 40', respectively, are provided for receiving the sleeve 37. Two blocking shoulders 41 and 42 are displaceably received each by one recess 43 and 44, respectively, in the bottom portion 24 and are biased by means of a compression spring 45 and 46, respectively, to the position shown in FIG. 1 wherein the two blocking shoulders project into the guide passage formed by the recesses 39 and 40 for the insertion of the lock tongue 11. In FIG. 1, it is shown how the blocking shoulder 41 then prevents insertion of the lock tongue 11 into engagement with the latch 18. The bottom portion 24 forms two grooves 47 and 48, and the top portion 25 forms two corresponding grooves 49 and 50, these grooves being located such that they register when the two portions of the lock housing are assembled. The passages thus formed by the grooves 47 and 49 and by the grooves 48 and 50, respectively, open in an edge surface of the lock housing 10 as will be seen from FIG. 5, and have flared opening portions. Preferably, they are arranged at an angle of 20° to the perpendicular of the direction of the insertion of the lock tongue into the lock housing, and converge from the openings thereof. Moreover, one passage preferably has a smaller width than the other one as will be seen from FIGS. 2 and 3.

The fittings 12 and 13 can be inserted into the passages 47, 49 and 48, 50, respectively, and has a width which is adjusted to the width of the respective passages. Each fitting forms a protuberance 51 at one side thereof, and a recess 52 is provided in the passages 47, 49 and 48, 50, respectively, to receive this protuberance. Each fitting forms a rectangular aperture 53 the rectangular cross section of which is somewhat larger than the rectangular cross section of the lock tongue 11 so that the lock tongue can be passed through the aperture. When one of the fittings 12 and 13 is inserted into the associated passage in the lock housing, it will eventually hit the corresponding block shoulder which can be depressed against the spring bias by the insertion of the fitting. This is illustrated in FIG. 6 where the fitting 12 is inserted in the passage 47, 49 and has depressed the blocking shoulder 41 against the bias of the spring 45 so that the blocking shoulder no longer prevents the insertion of the lock tongue 11. Thus, the lock tongue 11 according to FIG. 6 has been inserted into the passage 39, 40 and then initially has been passed through the aperture 53 of the fitting 12. However, the blocking shoulder 42 prevents continued displacement of the lock tongue 11 so that the tongue cannot be inserted to engage the lock mechanism. Not until also the fitting 13 has been inserted into the passage 48, 50 and has depressed the blocking shoulder 42 against the bias of the spring 46, the lock tongue can be inserted further into the lock housing passing through the aperture 53 of the fitting 13 so that the lock tongue can be lockingly engaged with the latch 18, which is shown in FIG. 7.

Thus, the lock can be locked with the lock tongue 11 inserted into the lock housing only if also the fittings 12 and 13 are inserted into the lock housing for safe attachment of all parts of the safety belt. When the lock tongue 11 is brought to the latched position the ejector 37 will be depressed against the bias of the spring 38 so that the lock tongue will be ejected from the lock housing under the bias of the spring 38 when the lock tongue 11 is disengaged from the lock housing by depression of the push button 22 for pivotal movement of the latch 18 to the releasing position against the bias of the spring 21. When the lock tongue 11 has been ejected from the lock housing, the two fittings 12 and 13 will be ejected from the lock housing under the bias of the associated springs 45 and 46. Thus, the blocking shoulders 41 and 42 operate as ejectors as far as the fittings 12 and 13 are concerned. Due to the fact that one fitting is wider than the other one and the protuberance 51 must be received by the recess 52 in order that the fitting can be inserted into the lock housing, the two fittings can be inserted simultaneously in the lock housing in one way only so that there is no risk of the two strap parts attached to the fittings being erroneously positioned (crossing or obliquely) when they are attached to the lock housing.

The lock housing, the blocking shoulders, the ejector, and the hook preferably are made of a plastic material while the latch, the frame, the lock tongue, and the fittings are made of punched steel sheet.

The blocking shoulders can be contructed in another way than that shown herein, e.g. as spring-biased balls which partly project into the guide passage for the lock tongue.

I claim:

1. Lock for safety belts having two hip strap parts and at least one further strap part, said lock comprising a lock housing (10) to be attached to one hip strap part and enclosing a lock mechanism (18) having a release member (22) to be actuated manually, a lock tongue (11) to be attached to the other hip strap part, which can be inserted into an insert opening (39, 40) in the lock housing for co-operation with the lock mechanism, and a fitting (12; 13) for the further strap part to be connected with the lock housing and the lock tongue by these elements being lockingly engaged with each other, characterized in that a blocking shoulder (41, 42) is provided in the lock housing, which is spring-biased to project partly into the insert opening (39, 40) for the lock tongue (11) under the spring bias so as to prevent insertion of the lock tongue through the opening to engagement with the lock mechanism, and that the lock housing forms an insert opening (47, 49; 48, 50) for the fitting (12; 13) for the insertion thereof transversely through the insert opening for the lock tongue, the fitting being engaged with the blocking shoulder and the blocking shoulder being displaced from the insert opening for the lock tongue against the spring bias, the fitting (12; 13) forming an opening (53) for the insertion of the lock tongue to retain the fitting in the lock housing when the lock tongue is engaged with the lock mechanism.

2. Lock as in claim 1, characterized in that the opening (47, 49; 48, 50) for the insertion of the fitting (12; 13) is arranged at an angle to the perpendicular to the direction for insertion of the lock tongue (11).

3. Lock as in claim 2, characterized in that the insertion opening (47, 49; 48, 50) is arranged at an angle of substantially 20° to the perpendicular.

4. Lock as in claim 2 having two openings (47, 49; 48, 50) for the insertion of two fittings (12; 13), characterized in that the insertion openings converge from the opening ends thereof.

5. Lock as in claim 1 comprising several fittings (12; 13), characterized in that the fittings and the associated insertion openings (47, 49; 48, 50) have different widths.

6. Lock as in claim 1, characterized in that the opening (39, 40) for the insertion of the lock tongue (11) is defined by two housing portions (24, 25) and that the blocking shoulder or the blocking shoulders (41, 36), respectively, are provided in one housing portion (39).

7. Lock as in claim 1, characterized in that an ejector for the ejection of the lock tongue (11) from the lock housing (40) comprises a spring-biased element (37) displaceable on the lock tongue (11) in the longitudinal direction thereof, which can be engaged with the lock housing (10) by the insertion of the lock tongue into the lock housing and then be displaced in relation to the lock tongue against the spring bias.

8. Lock as in claim 7, characterized in that the element (37) is received by a substantially rectangular longitudinal slot (32) in the lock tongue and is guided by a tail portion (34) extending in the longitudinal direction of the slot, said tail connecting to one end edge (33) of the slot and terminating at a distance from the other end edge (35) of the slot.

9. Lock as in claim 8, characterized in that the element (37) comprises a cylindrical sleeve.

10. Lock as in claim 8, characterized in that a helical spring (38) is passed onto the tail portion (34) and is engaged between the element (37) and said one end edge (33).

* * * * *

UNITED STATES PATENT AND TRADEMARK OFFICE

CERTIFICATE OF CORRECTION

PATENT NO. : 4,644,618
DATED : February 24, 1987
INVENTOR(S) : Gote E.Y. Holmberg, deceased et al It is certified that error appears in the above-identified patent and that said Letters Patent is hereby corrected as shown below:

Title page Item (54) should read --Lock For Safety Belts--.

Title page, inventors should read

--(76)Inventors: Gote E.Y. Holmberg, deceased, late of Anderstorp; by Brita G.E. Holmberg legal representative, Tokarp, Box 2010; by Dick L.L. Holmberg, legal representative, Bergkullavagen 12, both of S-334 00 Anderstorp, all of Sweden --.

Column 1, in the title, "Bells" should read -- Belts --.

Column 5, line 19, "contructed" should read --constructed --.

Signed and Sealed this

Eighth Day of December, 1987

*Attest:*

DONALD J. QUIGG

*Attesting Officer*

*Commissioner of Patents and Trademarks*